United States Patent [19]

Albers

[11] 4,436,339

[45] Mar. 13, 1984

[54] LAP DEVICE FOR WHEELCHAIR PATIENTS

[76] Inventor: Arthur L. H. Albers, 1916 Green Bay Rd., Grafton, Wis. 53024

[21] Appl. No.: 311,996

[22] Filed: Oct. 16, 1981

[51] Int. Cl.[3] ..... A47B 83/02

[52] U.S. Cl. ..... 297/153; 297/174; 297/DIG. 4; 108/152

[58] Field of Search ..... 297/153–155, 297/173, DIG. 4, 148, 174; 108/45, 46, 134, 152, 159

[56] References Cited

U.S. PATENT DOCUMENTS

| | | | |
|---|---|---|---|
| Re. 12,879 | 11/1908 | Unger | 297/153 |
| 664,542 | 12/1900 | Firnhaber | 297/153 |
| 945,119 | 1/1910 | Conrard | 297/153 X |
| 3,123,397 | 3/1964 | Murcott . | |
| 3,140,119 | 7/1964 | Offner | 297/DIG. 4 X |
| 3,575,466 | 4/1971 | Thomas et al. . | |
| 3,860,285 | 1/1975 | Hartman . | |
| 3,870,362 | 3/1975 | Larce . | |
| 3,999,798 | 12/1976 | Roulier . | |
| 4,155,126 | 5/1979 | Classen | 297/153 X |
| 4,288,122 | 9/1981 | Meek | 297/153 |

*Primary Examiner*—James T. McCall
*Assistant Examiner*—Peter R. Brown
*Attorney, Agent, or Firm*—Andrus, Sceales, Starke & Sawall

[57] ABSTRACT

An accessory-supporting attachment frame is removably coupled to the vertical bracing members which extend downwardly from the front terminus portions of the wheelchair armrests, said bracing members being disposed substantially rearwardly of the front edge of the wheelchair seat. The coupling is of the swing-down type. Stabilizing locators extend downwardly from the frame and engage the bracing members to position the frame horizontally. The frame is disposed below the plane of the armrests and extends from between the chair back and front seat edge and forwardly to beyond said edge. The frame is adapted to receive thereover an accessory, such as a tray, via a connection therebetween which permits support of the accessory on the tray while holding the accessory against horizontal movement. The coupling between the frame and bracing members is such as to be automatically releasable to protect the patient in the event the wheelchair tips forwardly so that the front edge of the frame and/or accessory engages the floor.

1 Claim, 8 Drawing Figures

Fig. 4
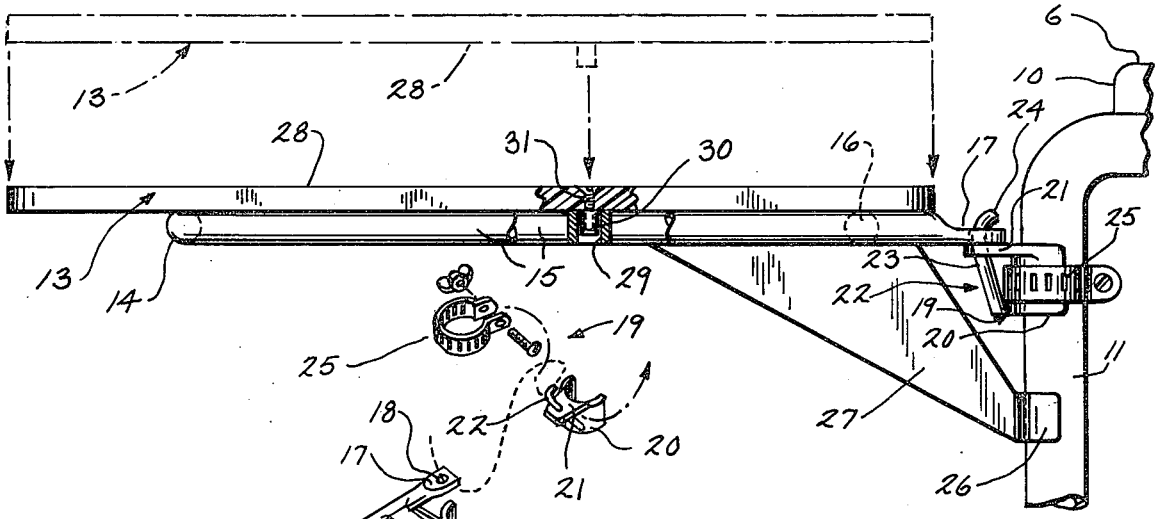
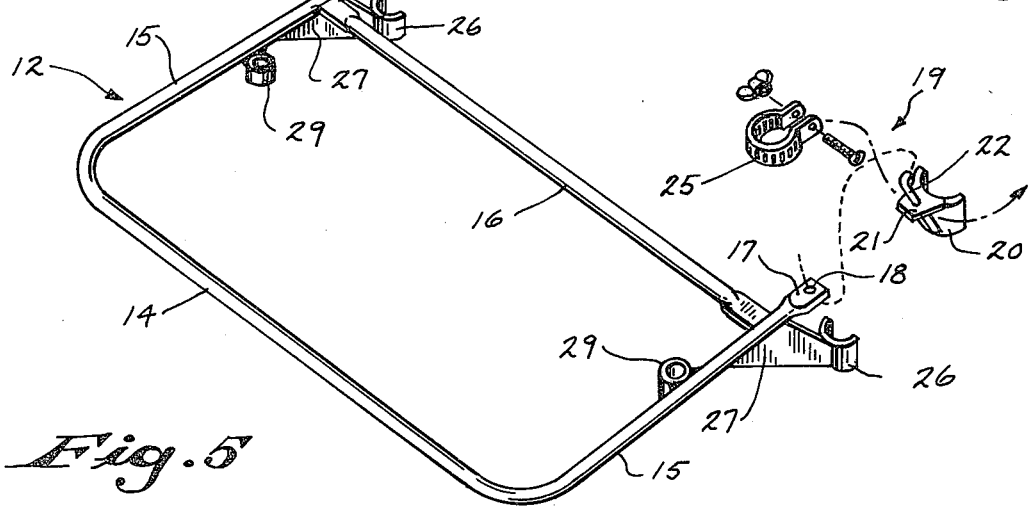
Fig. 5
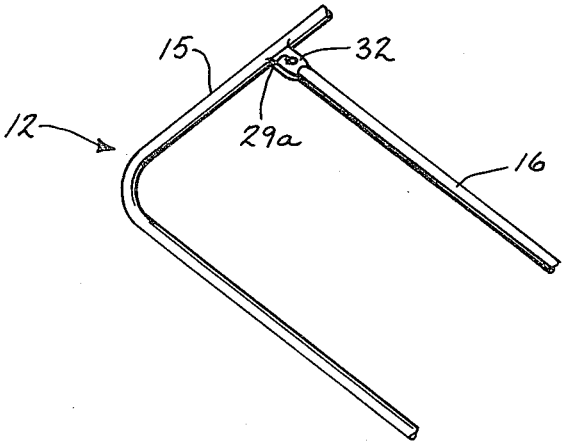
Fig. 6

LAP DEVICE FOR WHEELCHAIR PATIENTS

U.S. PRIOR ART OF INTEREST

U.S. Pat. No. 3,123,397, issued Mar. 3, 1964 to Murcott,

U.S. Pat. No. 3,575,466, issued Apr. 20, 1971 to Thomas et al.,

U.S. pat. No. 3,860,285, issued Jan. 14, 1975 to Hartman,

U.S. Pat. No. 3,870,362, issued Mar. 11, 1975 to Large,

U.S. Pat. No. 3,999,798, issued Dec. 28, 1976 to Roulier.

BACKGROUND AND SUMMARY OF THE INVENTION

This invention relates to a lap device for wheelchair patients such as paraplegics and the like.

Numerous lap devices for wheelchair patients have been previously proposed to provide a flat support above the lap for holding a food tray, occupational therapy materials, etc. for use by the patient. The above-identified patents illustrate such prior devices. In these prior constructions, the support generally is disposed on or slightly above the armrest of the chair and is foldable through a complex mechanism downwardly to the side of the chair when not in use. Also, in these prior constructions, the chair armrests extend from the back of the chair forwardly to above the front edge of the chair seat.

Many such chairs have been designed so that problems arise when it is desired to bring the patient up to a table. The front ends of the armrests tend to engage the table edge, thus limiting the patient's ability to move up close to the table. He thus must bend forward to use the table, which can be a very uncomfortable position.

Recent wheelchair designs have solved this problem by providing set-back armrests so that their front ends terminate substantially rearwardly of the front chair seat edge and above the middle of the pateient's lap rather than adjacent the knees. Suitable vertical bracing, forming part of the wheelchair frame, extends down from the front terminus portions of the armrests. The chair can thus be brought much farther under a table than before, and up to the point where the vertical bracing engages the table edge.

The resultant construction shortens the armrests substantially so that the lap devices of the prior patents would be substantially smaller and less useful, and/or might in some instances too tightly confine the patient.

The concepts of the present invention overcome the problems created by shortening of the armrests.

In accordance with one aspect of the invention, an accessory-supporting attachment frame is removably coupled to the vertical bracing members which extend downwardly from the front terminus portions of the wheelchair armrests, said bracing members being disposed substantially rearwardly of the front edge of the wheelchair seat. The coupling is of the swing-down type. Stabilizing locators extend downwardly from the frame and engage the bracing members to position the frame horizontally. The frame is disposed below the plane of the armrests and extends from between the chair back and front seat edge and forwardly to beyond said edge.

In accordance with another aspect of the invention, the frame is adapted to receive thereover an accessory, such as a tray, via a connection therebetween which permits support of the accessory on the tray while holding the accessory against horizontal movement.

In accordance with a further aspect of the invention, the coupling between the frame and bracing members is such as to be automatically releasable to protect the patient in the event the wheelchair tips forwardly so that the front edge of the frame and/or accessory engages the floor.

BRIEF DESCRIPTION OF THE DRAWINGS

The accompanying drawings illustrate the best mode presently contemplated by the inventor for carrying out the invention.

In the drawings:

FIG. 4 is a side elevation showing one manner of connecting an accessory to the frame;

FIG. 5 is an exploded perspective view of the frame and its associated coupling and connector parts;

FIG. 6 is a fragmentary view of another form of frame connector part;

DESCRIPTION OF THE PREFERRED EMBODIMENT

Figure 1:
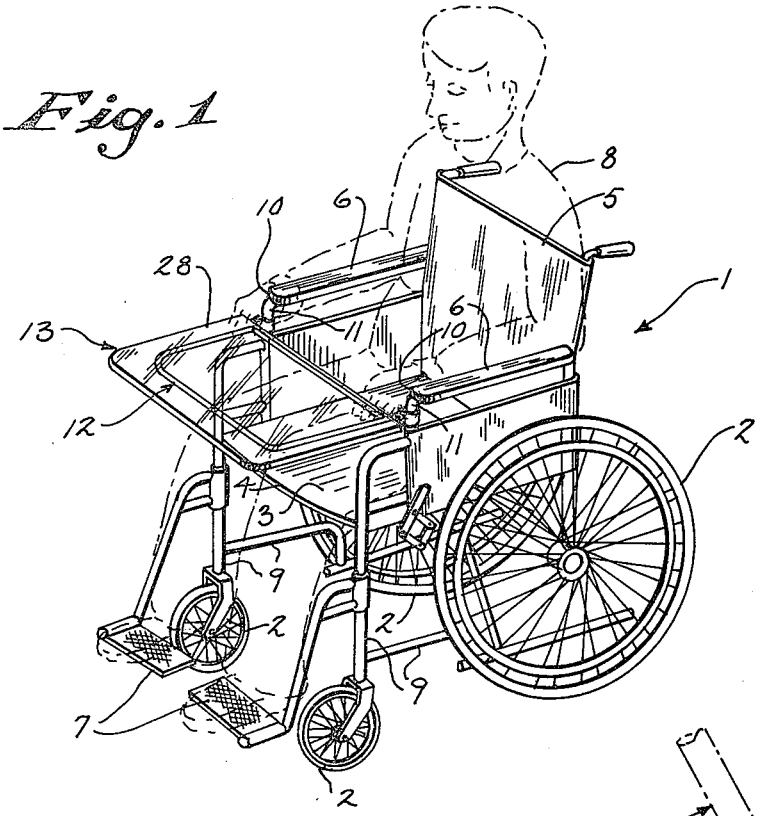
FIG. 1 is a perspective view of a wheelchair patient utilizing the lap device of the invention.

As shown in FIG. 1 of the drawings, the various aspects of the invention are adapted to be used in conjunction with a wheelchair 1 having the usual wheels 2, a seat 3 having a front edge 4, a back 5, armrests 6 and, if desired, footrests 7 for the patient 8. The elements of wheelchair 1 are connected together into a complete assembly by a suitable frame 9.

It is to be noted that the front terminus portions 10 of armrests 6 are disposed rearwardly of front seat edge 4 and between the latter and back 5. Terminus portions 10 are supported by portions of frame 9 which comprise downwardly extending generally vertical bracing members 11.

On numerous occasions, it is desirable for patient 8 to have available a lap device for supporting food, etc. For this purpose, a frame 12 is provided which is adapted to be removably coupled to wheelchair 1 and to support an accessory 13.

In the present embodiment, frame 12 comprises a generally rectangular tubular member having a front side 14, a pair of rearwardly extending spaced side legs 15 and a rear cross-brace 16. Frame 12 is removably coupled to bracing members 11 by a vertical swing-type coupling means. For this purpose, the rear terminus portions of legs 15 are flattened at 17 with openings 18 disposed therein. A coupling assembly 19 is fixedly mounted to each bracing member 11, with assemblies 19 each including an arcuate base member 20 having a forwardly extending top lip 21 and a curved hook 22 having an upwardly forwardly inclined body portion 23 which merges at its upper end into a rearwardly bent tail 24. Each base member 20 fits over its respective bracing member 11 and is fixedly secured thereto by a clamp 25 of any suitable type and which is shown as surrounding base member 20 and bracing member 11. The coupling means is disposed below a horizontal plane containing armrests 6.

Figure 2:
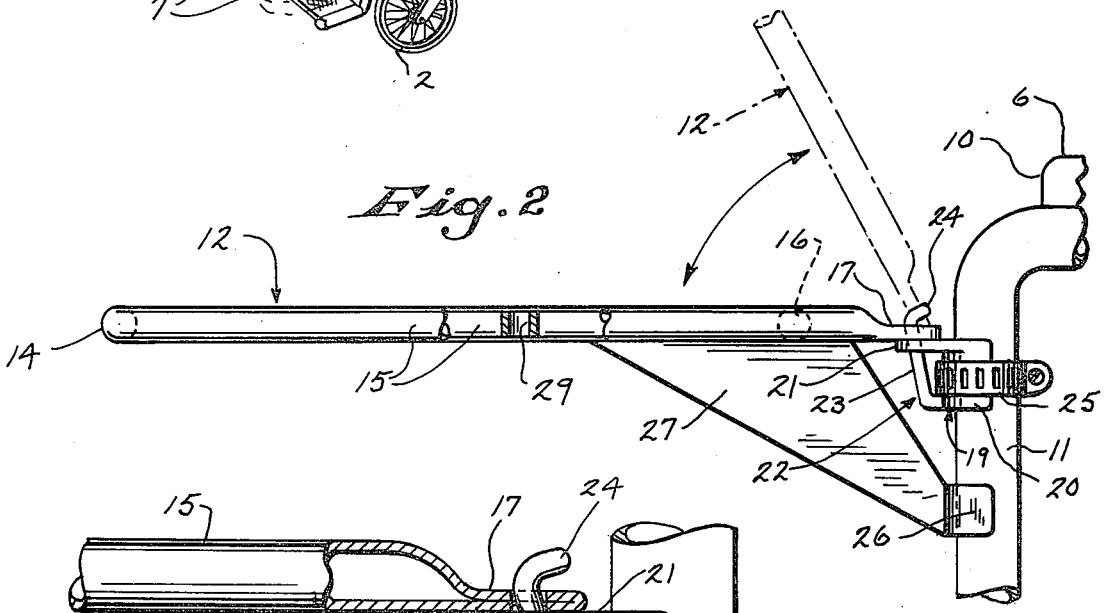
FIG. 2 is an enlarged side elevation of the frame and showing the manner of coupling to the wheelchair bracing members.
Figure 3:
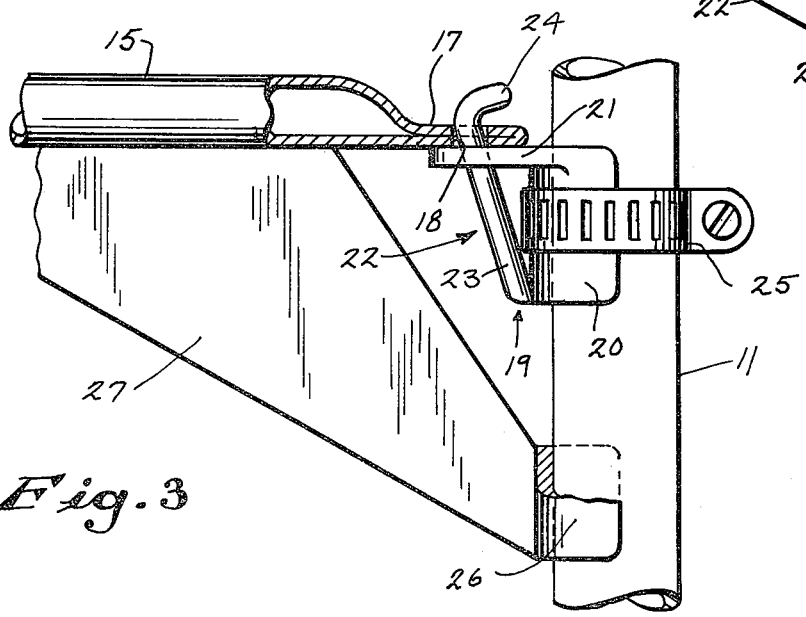
FIG. 3 is an enlarged fragmentary detail of the coupling and stabilizing locator devices.

As shown in FIG. 2, frame 12 is adapted to be easily mounted to wheelchair 1. This is accomplished by raising the frame to a semi-vertical position with its rear end adjacent hooks 22. Rear corner openings 18 are then shifted forwardly over hook tails 24 and the frame then pivoted arcuately forwardly and downwardly about a transverse horizontal axis which extends between members 11 until it reaches the lowered horizontal position shown in full lines in FIG. 2. During this movement, openings 18 slip down over hook body portion 23. Once in lowered position, the rear end of frame 12 is prevented from raising vertically by tails 24 which confine flattened portions 17 against lips 21.

The reverse procedure will release frame 12 from wheelchair 1, and can be performed by confining frame legs 15 between the patient's arms or fists, finger dexterity not being required.

Frame 12 is held in horizontal position by stabilizing locators which comprise arcuate members 26 disposed on the rear ends of downwardly and rearwardly extending frame arms 27 and which fit over bracing members 11.

In its installed position, frame 12 is disposed substantially below the plane of armrests 6, has its rear edge well forward of chair back 5, and extends forwardly to well beyond the front edge 4 of seat 3. In most instances, it can easily fit under a table.

Frame 12 is adapted to support a lap device completing accessory 13, which in FIGS. 1 and 4 is shown as a flat tray 28. Tray 28 is preferably made of clear plastic material so that, when installed in front of the patient, he can see his legs and feet through it. This will lessen the chance of the patient bumping into things with his feet when he travels along a hallway or the like in the chair.

Frame 12 and accessory 13 are removably joined by connecting means which, in the present embodiment, comprises a pin-and-socket connection. Referring especially to FIGS. 4 and 5, a socket 29 is disposed adjacent and secured to the inner side of each frame leg 15, with sockets 29 being spaced transversely from each other. A pin 30 is mounted to the underside of the side edge portions of tray 28 as by a screw 31 which is countersunk into and passes through tray 28 and is ultimately threaded into pin 30. To connect frame 12 and tray 28, the patient need only lower tray 28 downwardly (with arms or fists if need be) until pins 30 register with and enter sockets 29. Frame 12 acts as a stop to limit downward movement of tray 28 when it is in desired position.

FIG. 6 shows another form of socket **29*a* which, although disposed adjacent legs 15, is formed in a flattened portion 32 at the ends of cross-brace 16**.

Figure 7:
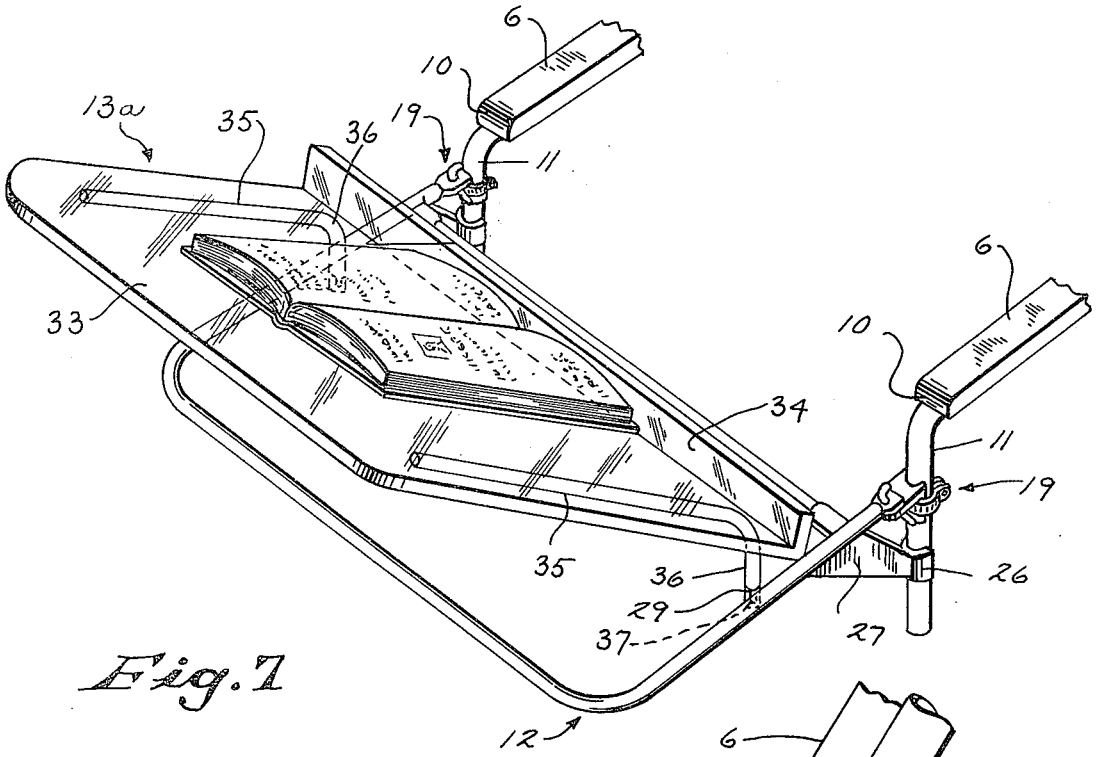
FIG. 7 is a perspective view of another form of accessory supported by the frame.

Instead of taking the form of a tray 28, accessory 13 may take other desirable forms. For example, and as shown in FIG. 7, an accessory **13*a* may take the form of an inclined bookrest formed of a support sheet 33 of clear plastic having a bottom ledge 34. In this instance, strengthening rods 35 are disposed along and secured to the lower side edge portions of sheet 33 and are bent downwardly to form vertical legs 36 having end pins 37 which enter frame sockets 29**.

Both accessories 13 and **13*a* extend forwardly to beyond the front edge 4 of seat 3, although accessory 13*a*** would have to be removed before the patient moves up close to a table.

Figure 8:
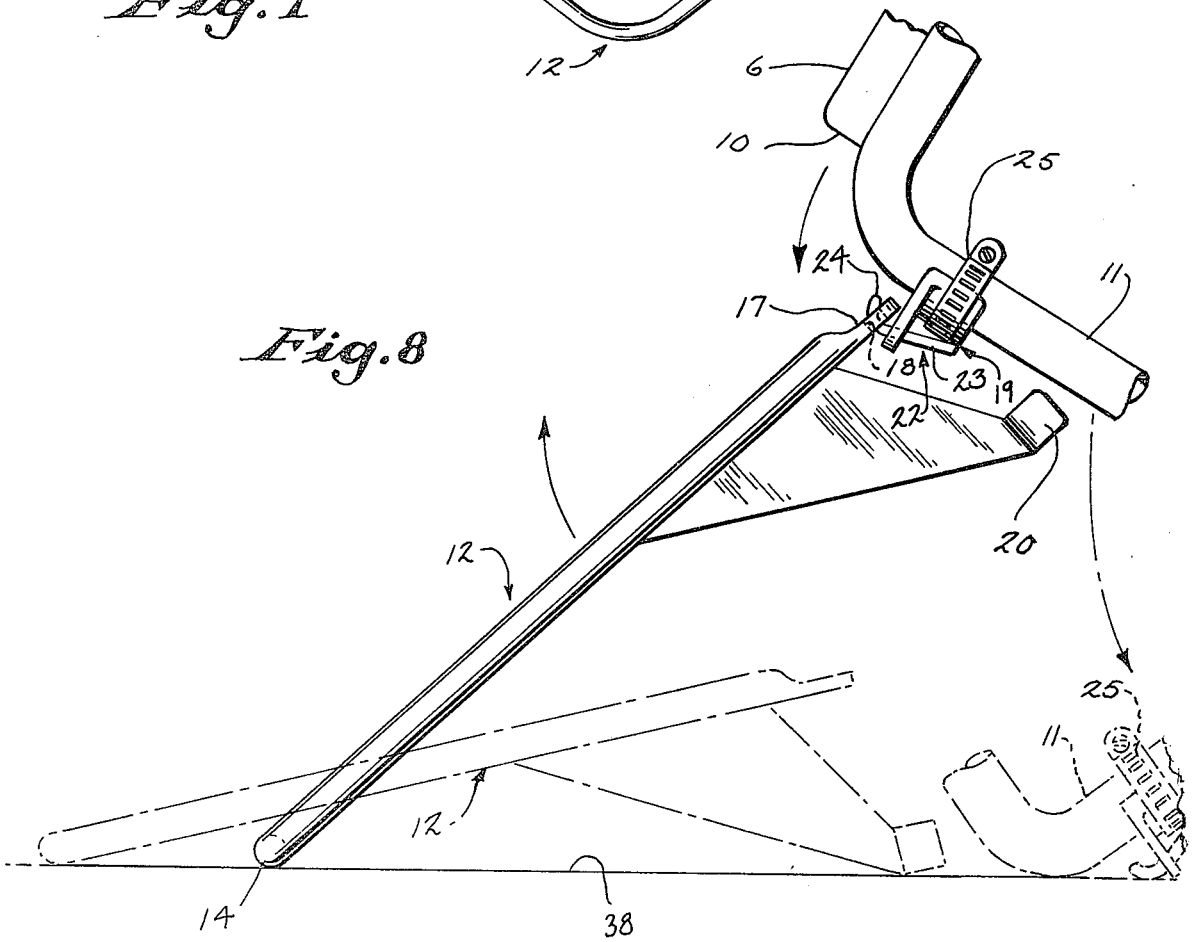
FIG. 8 is an enlarged side elevation showing the manner of automatic release of the frame from the wheelchair in the event the latter tips forwardly to the floor.

The construction of the coupling between frame 12 and bracing members 11 is such that it will quickly and automatically release if by chance wheelchair 1 falls forwardly to the floor with the patient in it. FIG. 8 illustrates such a situation with only a frame 12, although the decoupling will occur even if an accessory is mounted to the frame at the time. As the chair falls forwardly and the front of frame 12 is subjected to vertical forces, as by front side 14 engaging floor 38, frame 12 will be lifted up, relative to chair 1, and pivoted about hook 22 so that opening 18 slides off the hook and frame 12 is fully released from the chair so that it falls freely to the floor.

The lap device of the present invention provides a significant advance in assistance for wheelchair-ridden patients.

Various modes of carrying out the invention are contemplated as being within the scope of the following claims particularly pointing out and distinctly claiming the subject matter which is regarded as the invention.

I claim:

1. In combination with a wheelchair having a seat with a front edge, a back, armrests set back from the said front edge of said seat, and vertical bracing members extending downwardly from the front terminus portions of said armrests:

(a) a lap device for positioning in front of the patient, (b) coupling means for removably attaching the rear portion of said lap device to said vertical bracing members below the plane of said armrests, (c) said coupling means being constructed to respectively connect or disconnect said lap device from said vertical bracing members by arcuate downward or upward pivoting of said lap device rear portion about a transverse horizontal axis extending between said bracing members, said coupling means comprising:

(1) coupling assemblies secured to said vertical bracing members, (2) said coupling assemblies each including a base, an upper lip, and a hook having an upwardly forwardly inclined body portion which merges at its upper end into a rearwardly bent tail, (3) and opening means formed in the rear corner of said lap device for being received over said hooks, (4) said tails forming means to confine said rear corners against said upper lips when said lap device is in its lowered coupled position, (d) and stabilizing locator means connected to said lap device and engageable with said bracing members upon downward pivoting of said lap device, (e) the said opening means of said lap device being automatically movable over said hook tails upon forward tipping of the wheelchair to the floor to thereby automatically decouple said frame from the wheelchair.

* * * * *